US006516499B2

(12) United States Patent
Yamaguchi et al.

(10) Patent No.: US 6,516,499 B2
(45) Date of Patent: Feb. 11, 2003

(54) LINEAR SLIDE FASTENER AND MANUFACTURING METHOD THEREOF

(75) Inventors: Yoshiharu Yamaguchi, Toyama-ken (JP); Mutsuo Hirota, Toyama-ken (JP); Hiromi Aoshima, Toyama-ken (JP)

(73) Assignee: YKK Corporation, Tokyo (JP)

( * ) Notice: Subject to any disclaimer, the term of this patent is extended or adjusted under 35 U.S.C. 154(b) by 36 days.

(21) Appl. No.: 09/746,221

(22) Filed: Dec. 26, 2000

(65) Prior Publication Data

US 2001/0013158 A1 Aug. 16, 2001

(30) Foreign Application Priority Data

Dec. 27, 1999 (JP) ..... 11-369069

(51) Int. Cl.[7] ..... A44B 19/40

(52) U.S. Cl. ..... 24/391; 24/389; 24/397; 24/398

(58) Field of Search ..... 24/391, 389, 397, 24/398

(56) References Cited

U.S. PATENT DOCUMENTS

| | | | | |
|---|---|---|---|---|
| 3,456,306 A | * | 7/1969 | Heimberger | 24/391 |
| 4,319,387 A | * | 3/1982 | Yoshida | 24/391 |
| 4,566,156 A | * | 1/1986 | Sarasue et al. | 24/398 |
| 4,888,859 A | * | 12/1989 | Horita | 24/389 |
| 5,975,988 A | * | 11/1999 | Christianson | 451/28 |
| 6,314,623 B1 | * | 11/2001 | Wakai et al. | 24/397 |

FOREIGN PATENT DOCUMENTS

| | | |
|---|---|---|
| GB | 516354 | 1/1940 |
| GB | 997612 | 7/1965 |
| JP | 51-4825 | 2/1976 |

* cited by examiner

*Primary Examiner*—Victor Sakran
(74) *Attorney, Agent, or Firm*—Finnegan, Henderson, Farabow, Garrett & Dunner, L.L.P.

(57) ABSTRACT

An object of the present invention is to provide a linear slide fastener capable of maintaining a stabilized condition in which an attachment yarn for attaching a fastener element is never out out by abrasion due to a contact with other object or sliding of a slider. A coil-like or zigzag-like linear fastener element row is attached to a fastener tape with a multi-filament attachment yarn or a sewing yarn of double lock sewing system. Then, synthetic resin material having adhesive property is applied to an entangled portion between a looper yarn disposed on the linear fastener element row and a needle yarn so as to permeate the entangled portion and harden. Consequently, the attachment yarn is coated and fixed with the synthetic resin material, As the attachment yarn, a weaving yarn or a warp knitting yarn is used. The synthetic resin material is applied to the entangled portion or an intersecting portion so as to permeate them. As a result, a strong, abrasion resistant yarn can be formed and the yarns are bonded with each other so as to achieve a stabilized condition which provides an excellent performance for guiding a slider.

12 Claims, 14 Drawing Sheets

LINEAR SLIDE FASTENER AND MANUFACTURING METHOD THEREOF

BACKGROUND OF THE INVENTION

1. Field of the Invention

The present invention relates to an abrasion resistant linear slide fastener and a manufacturing method thereof, wherein coil-like fastener element row formed by winding thermoplastic resin mono-filament or zigzag-like fastener element row formed by bending mono-filament in zigzag shape is attached to a side edge of fastener tape with multi-filament attachment yarn and thermoplastic resin or thermo-setting resin is applied to this attachment yarn and made to permeate into the yarn and harden.

2. Description of the Related Art

According to a conventional linear slide fastener disclosed in Japanese Utility Model Publication No. 51-4825, as shown in FIG. 26, a coil-like fastener element row 1' is formed by winding thermoplastic resin mono-filament in the shape of a coil on a side edge of a fastener tape 10', and belt-like thermoplastic resin material 23' having a melting point lower than that of the coil-like fastener element is overlaid on a top of the coil-like fastener element row 1'. Then, this thermoplastic resin material 23' and the coil- like fastener element row 1' are sewed with a sewing yarn 12' or the coil-like fastener element is sewed with the thermoplastic resin filament applied to the sewing yarn. Then, the thermoplastic resin material 23' or sewing yarn 12' is heated under pressure, so that the thermoplastic resin is melted and then permeates into the sewing yarn 12' and hardens. Consequently, the linear slide fastener, in which a convex sewing yarn swollen portion 28' is formed continuously with a thickness serving as a guide of the slider, is produced.

In the linear slide fastener shown In FIG. 26 described above, the belt-like thermoplastic resin material is overlaid on the top of the coil-like fastener element and sewed with a sewing yarn. Alternatively, thermoplastic resin filament is applied to the sewing yarn and then the coil-like fastener element is sewed. After that, the belt-like thermoplastic resin material or thermoplastic resin filament is heated under pressure so as to be melted, so that a convex swollen portion, in which the sewing yarn is sealed, is formed. Therefore, the swollen portion is rigid, so that flexibility becomes short. Thus, this fastener stringer has such a problem that a sliding resistance of its slider is so high that the slider cannot be operated smoothly.

SUMMARY OF THE INVENTION

The present invention has been achieved in views of the above described problems. It is an object of an aspect of the present invention to provide a linear slide fastener capable of maintaining a stabilized condition in which an attachment yarn for fixing a linear fastener element row to a side edge of a fastener tape is never cut out by abrasion due to a contact with other thing or a sliding of a slider having appropriate rigidity and flexibility and exerting excellent resistances against lateral pulling and bending of the fastener chain.

It Is an object of the invention to provide a linear slide fastener capable of preventing a cut-out of the attachment yarn, deviation of the linear fastener element row and the like by specifying a configuration and structure of the attachment yarn for fixing the linear fastener element row to the fastener tape.

It is also an object of the invention to provide a linear slide fastener in which the synthetic resin material is used appropriately and effectively, and the synthetic resin material is applied to the attachment yarn, core thread blade and fastener tape to permeate and harden, so as to fix the linear fastener element row firmly in a stabilized condition, thereby achieving an excellent fastener function.

It is also an object of the invention to provide a linear slide fastener in which various types of the synthetic resin material are used appropriately and effectively by specifying the type of the synthetic resin material for fixing the attachment yarn and the linear fastener element row is fixed to the fastener tape firmly in a stabilized condition.

It is also an object of the invention to provide a linear slide fastener in which a melting point of the synthetic resin material is specified so as to use various types of the synthetic resin materials for fixing the attachment yarn appropriately and effectively, thereby making it possible to fix the linear fastener element row to the fastener tape easily.

It is an object of another aspect of the invention to provide a manufacturing method of a linear slide fastener capable of maintaining a stabilized condition in which an attachment yarn for fixing the linear fastener element row to a side edge of the fastener tape is never cut out by abrasion due to a contact with other thing or a sliding of a slider, having appropriate rigidity and flexibility and exerting excellent resistances against lateral pulling and banding of the fastener chain.

It is an object of the invention to provide a manufacturing method of a linear slide fastener in which the synthetic resin is applied to the attachment yarn exposed on a rear side of the fastener tape to permeate the attachment yarn and harden so that the attachment yarn is fixed to the fastener tape.

It is also an object of the invention to provide a production method of a linear slide fastener in which solution of thermoplastic resin or thermo-setting resin adhesive agent, resin film, resin mono-filament or resin powder is used as the synthetic resin material, and the synthetic resin material is attached or applied to the attachment yarn on the fastener tape and melted by heating so that the fastener tape is coated with the synthetic resin.

To achieve the above described object, according to an aspect of the invention, there is provided a linear slide fastener, wherein a linear fastener element row is attached to a side edge of a fastener tape with a multi-fiber attachment yarn, and synthetic resin material having adhesive property is applied to the attachment yarn fixed on the linear fastener element row so that the synthetic resin material permeates the attachment yarn and hardens to coat the surface of the attachment yarn.

Preferably, the linear fastener element row is sewed to the side edge of the fastener tape using a sewing yarn as the attachment yarn for attaching the linear fastener element row.

Alternatively, the linear fastener element row is woven into the side edge of the fastener tape, using a weaving yarn of warp and weft for weaving the fastener tape, as the attachment yarn for attaching the linear fastener element row.

Alternatively, the linear fastener element row is knitted into the side edge of the fastener tape using a warp knitting yarn for knitting the fastener tape as the attachment yarn for attaching the linear fastener element row.

Preferably, the synthetic resin material is applied to an entangled portion or intersecting portion of the attachment yarn of the sewing yarn, weaving yarn or warp knitting yarn for attaching the linear fastener element row to the fastener tape, so as to permeate, and the respective attachment yarns are bonded with each other integratedly by the synthetic resin material so that the surface of the attachment yarns are coated with the synthetic resin material.

Preferably, the synthetic resin material is applied to the attachment yarn for attaching the linear fastener element row to the fastener tape, and a core thread incorporated by the linear fastener element row or a blade attached to the linear fastener element row so as to permeate, so that the attachment yarn and core thread or blade is hardened integratedly with the synthetic resin material so as to coat the surface of the attachment yarn with the synthetic resin material.

Also preferably, the synthetic resin material is applied to the attachment yarn for attaching the linear fastener element row to the fastener tape and the fastener tape to permeate them so that the attachment yarn and fastener tape are hardened integratedly with the synthetic resin material, so as to coat the surface of the attachment yarn with the synthetic resin material.

Also preferably, the synthetic resin material is applied to the attachment yarn for attaching the linear fastener element row, exposed on the rear side of the fastener tape to permeate the attachment yarn and harden, so that the attachment yarn on the rear side of the fastener tape is coated and fixed with the synthetic resin material.

Preferably, the synthetic resin material to be applied to the surface of the attachment yarn is formed of solution of thermoplastic or thermo-setting synthetic resin adhesive agent.

Alternatively, the synthetic resin material to be applied to the surface of the attachment yarn is formed of synthetic resin film.

Alternatively, the synthetic resin material to be applied to the surface of the attachment yarn is formed of synthetic resin mono-filament.

Further alternatively, the synthetic resin material to be applied to the surface of the attachment yarn is formed of synthetic resin powder.

Preferably, the synthetic resin material to be applied to the attachment yarn, core thread, blade, fastener tape and the like and left to permeate and harden, is formed of synthetic resin material having a melting point lower than that of material of the fastener stringer.

According to another aspect of the invention, there is provided a manufacturing method of a linear slide fastener for fixing a linear fastener element row to a fastener tape, comprising the steps of: attaching the linear fastener element row to a side edge of the fastener tape with a multi-fiber attachment yarn; applying synthetic resin material to the attachment yarn disposed on a top surface of the linear fastener element row so that the synthetic resin material permeates; and applying the synthetic resin material to permeate the attachment yarn to harden, so Mat the surface of the attachment yarn is coated with the synthetic resin material.

Preferably the method further comprises a step of applying the synthetic resin material to the surface of the attachment yarn for attaching the linear fastener element row, exposed on the rear side of the fastener tape so that the synthetic resin material permeates and hardens.

Preferably, the synthetic resin material to be applied to the surface of the attachment yarn is composed of a solution of thermoplastic adhesive agent or thermo-setting adhesive agent, the method further comprising a step of applying the adhesive agent to the surface of the attachment yarn so that the adhesive agent permeates and hardens.

Alternatively, the synthetic resin material to be applied to the surface of the attachment yarn is composed of thermoplastic or thermo-setting resin film, resin mono-filament or resin powder, the method further comprising a step of attaching or applying the film, mono-filament or powder to the multi-fiber attachment yarn attached on the fastener tape and melting by heating.

DESCRIPTION OF THE PREFERRED EMBODIMENTS

Hereinafter, embodiments of a linear slide fastener and a manufacturing method thereof according to the present invention will be described in detail with reference to the accompanying drawings.

Figure 1:
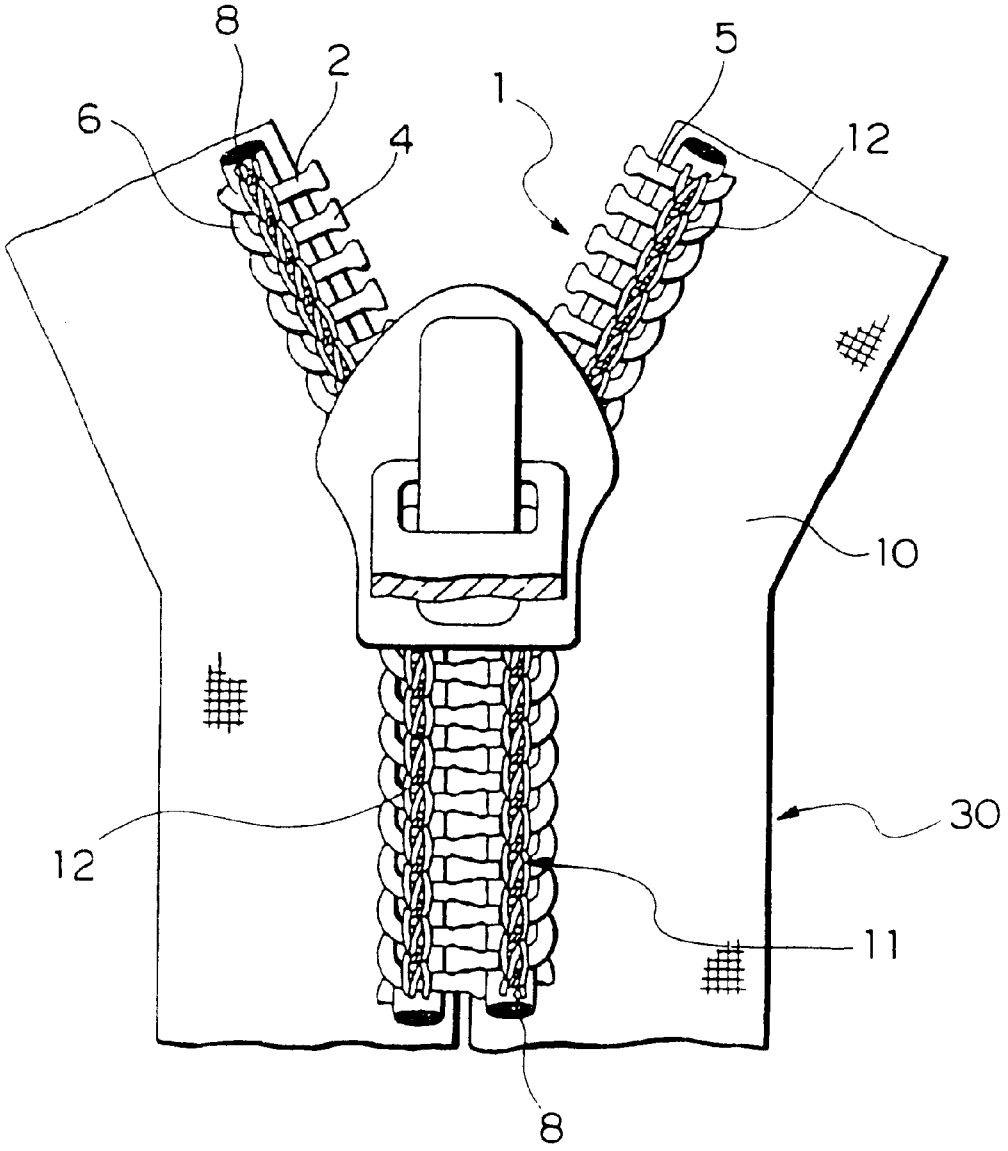
FIG. 1 is a front view of a linear slide fastener.
Figure 2:
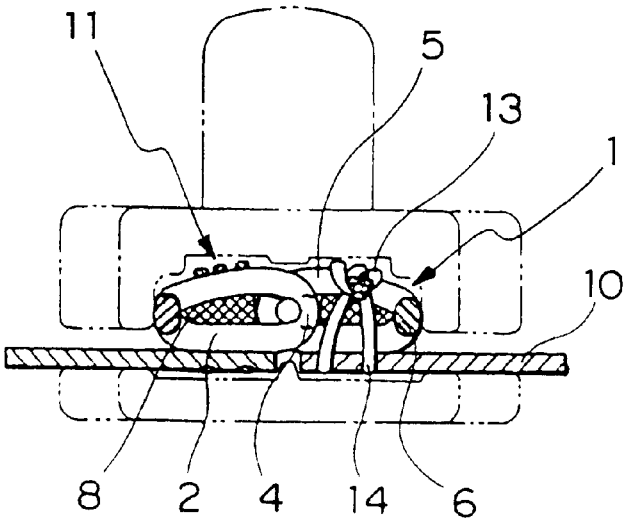
FIG. 2 is a cross sectional view of the linear slide fastener.

As shown in FIGS. 1 and 2, a linear fastener element row 1 of the linear slide fastener of the present invention is formed by winding the mono-filament of synthetic resin such as polytmide, polyester or the like in the shape of coil so that a coupling head 4, leg portions 5 and an inverted portion 6 are formed. Then, a core thread 8 composed of twisting yarn of multi-filament of synthetic fiber such as polyamide, polyester or the like is inserted into this coil-like fastener element 2 and this coil-like fastener element 2 is sewed on a side edge of a fastener tape 10 using an attachment yarn 11 of multi-fiber formed of multiple synthetic fiber filaments, namely a sewing yarn 12.

As for sewing means, double lock sewing looper yarns 13, which are two yarns provided by a needle, are disposed on the upper leg portion 5 of the coil-like fastener element 2 as upper yarn, while a double lock sewing needle yarn 14 is disposed on the rear of the fastener tape 10 as lover yarn. Meanwhile, the coil-like fastener element 2 is sewed to the fastener tape 10 by arranging two rows of double lock sewing system with two yarns by a needle or by double look sewing system with three yarns by two needles.

A characteristic feature of the linear slide fastener of the present invention is that the coil-like fastener elements 2 are used as the linear fastener element row 1, and a solution of a synthetic resin adhesive agent 24 as a synthetic resin material 23 is applied to an entangled portion 20 of the looper yarn 13 and needle yarn 14 as the attachment yarn 11 or sewing yarn 12 for attaching this coil-like fastener element 2 to the fastener tape 10, so that it permeates the entangled portion 20 and hardens.

Figure 3:
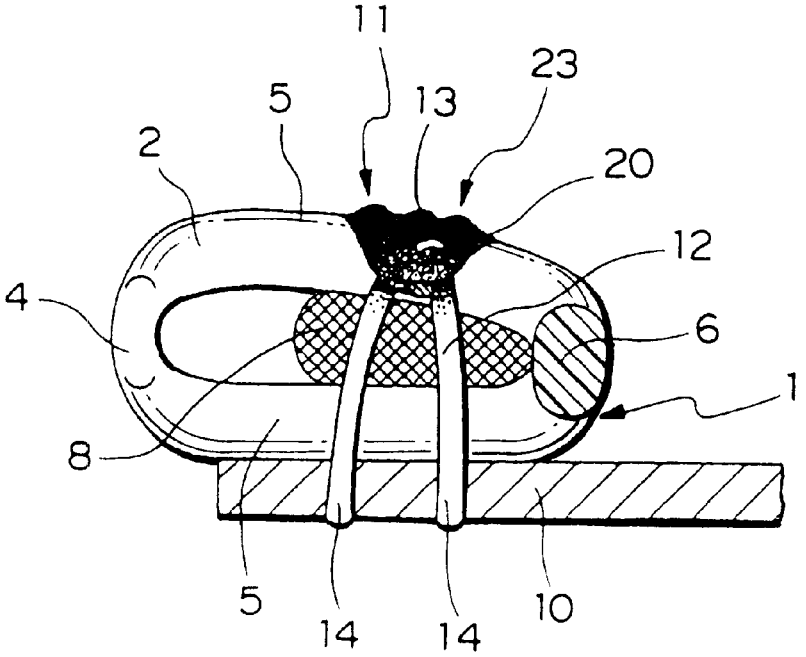
FIG. 3 is an enlarged fragmentary cross sectional view of a linear slide fastener stringer according to a first embodiment of the present invention.
Figure 4:
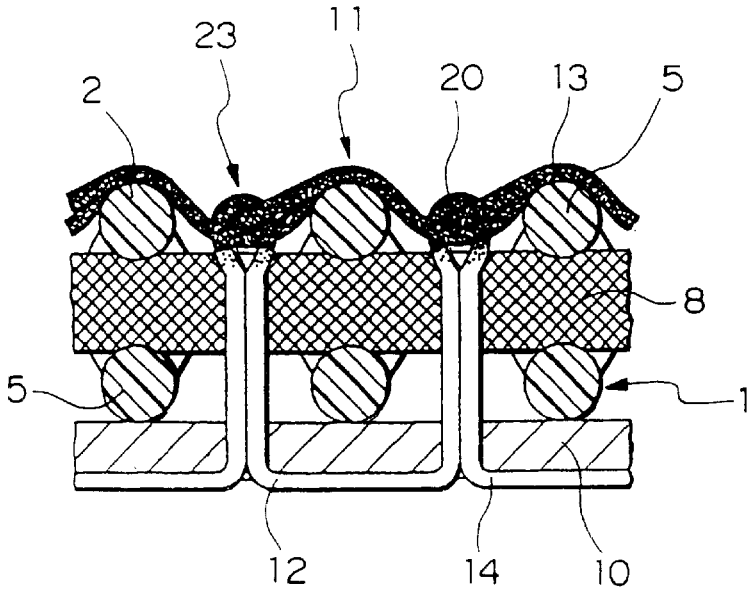
FIG. 4 is an enlarged fragmentary longitudinal sectional view of the slide fastener stringer of FIG. 3.

In a linear slide fastener of a first embodiment of the invention shown in FIGS. 3 and 4, the synthetic resin adhesive agent 24 as the synthetic resin material 23 having adhesive property is applied to the entangled portion 20 in which the looper yarn 13 and the needle yarn 14 are entangled with each other as the sewing yarns 12 of double lock sewing system, disposed on an upper face of the upper leg portion 5 of the coil-like fastener element 2, so that the solution of the adhesive agent 24 permeates a structure of the entangled portion 20 and hardens. Therefore, the surface of the sewing yarns 12 appearing in the sewing state on the top face of the coil-like fastener element 2 is coated with the synthetic resin material 23 so as to protect the sewing yarn 12 thereby preventing that the sewing yarn 12 from being worn by sliding of the slider. Further, the looper yarn 13 and the needle yarn 14 are bonded integratedly by the adhesive agent 24 so that a strong fastener stringer is produced.

The synthetic resin adhesive agent 24 for use for coating the surface of the attachment yarn 11 is selected from thermoplastic resin or thermo-setting resin adhesive agent such as polyester base, polyamide base, epoxy resin base, vinyl acetate resin, vinyl chloride resin base, acrylic resin base and the like appropriately depending on materials of the coil-like fastener element 2, a zigzag-like fastener element 3, the core thread 8, a blade 9, and the fastener tape 10.

Figure 5:
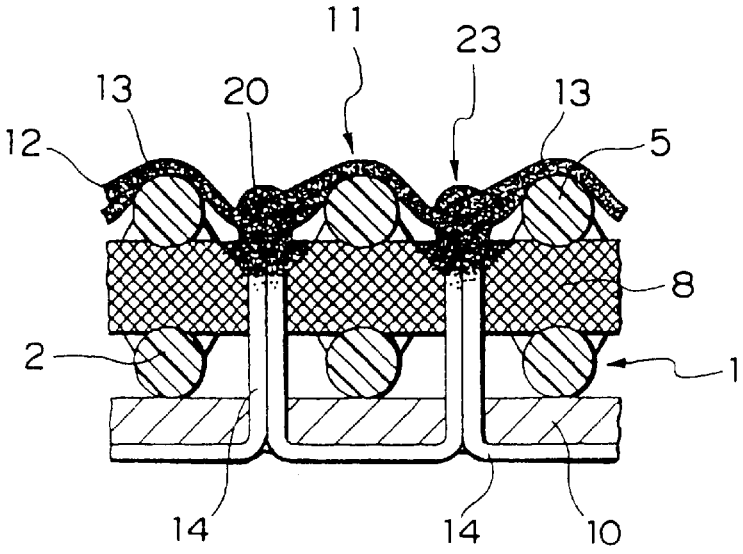
FIG. 5 is an enlarged fragmentary longitudinal sectional view of the linear slide fastener stringer according to a second embodiment of the present invention.

According to a linear slide fastener of a second embodiment of the invention shown in FIG. 5, in the fastener stringer, the coil-like fastener element 2 is used as the linear fastener element row 1 and then, the core thread 8 composed of synthetic fiber multi-filament is made to run through an interior of this coil-like fastener element 2 and this coil-like fastener element 2 is sewed on the side edge of the fastener tape 10 with the sewing yarn 12 of double lock sewing system. Then, solution of the synthetic resin adhesive agent 24 is applied to an entire surface of the looper yarn 13 of the double ring sewing system, the entangled portion 20 of the needle yarn 14 and the core thread 8 near the entangled portion 20 to permeate them and harden. Consequently, the entangled portion 20 of the sewing yarn 12 and part of the core thread 8 are bonded with each other integratedly by the synthetic resin adhesive agent 24, and because the synthetic resin material 23 is applied to the surface of the sewing yarn 12 as the attachment yarn 11, the strong attachment yarn 11 is formed. As a result, this linear slide fastener allows the slider to slide smoothly and has an excellent abrasion resistance against such a sliding.

Figure 6:
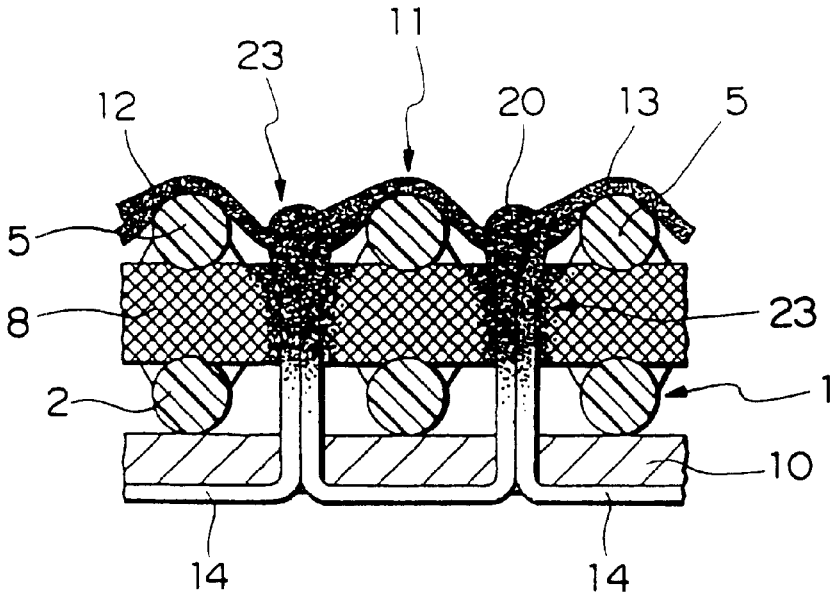
FIG. 6 is an enlarged fragmentary longitudinal sectional view of the linear slide fastener stringer according to a third embodiment of the present invention.

According to a linear slide fastener of a third embodiment of the invention shown in FIG. 6, in the fastener stringer, the coil-like fastener element 2 in used as the linear fastener element row 1 and the core thread 8 composed of synthetic fiber is made to run through an interior of this coil-like fastener element 2 and this coil-like fastener element 2 is sewed on the side edge of the fastener tape 10 with the looper yarn 13 and needle yarn 14 as the sewing yarn 12 for double look sewing system. Then, solution of the synthetic resin adhesive agent 24 is applied to an entire surface of the looper yarn 13 of the double lock sewing system, the entangled portion 20 of the needle yarn 14 and a portion of the core thread 8 which the needle yarn 14 pierces, and permeate them and harden. Consequently, the looper yarn 13, needle yarn 14 and core thread 8 are bonded with each other integratedly by the synthetic resin adhesive agent 24, and because the synthetic resin material 23 is applied to the surface of the sewing yam 12 as the attachment yarn 11, the strong attachment yarn 11 is formed. As A result, this linear slide fastener allows the slider to slide smoothly and has an excellent abrasion resistance against such a sliding.

According to the linear slider of the second, third embodiment described above, even when the looper yarn 13 disposed on the top face of the upper leg portion 5 of the coil-like fastener element 2 is worn and cut by abrasion, the coil-like fastener element 2 is never removed from the fastener tape 10 because the core thread 8 and the needle yarn 14 piercing the core thread 8 are bonded with each other such that they are hardened.

Figure 7:
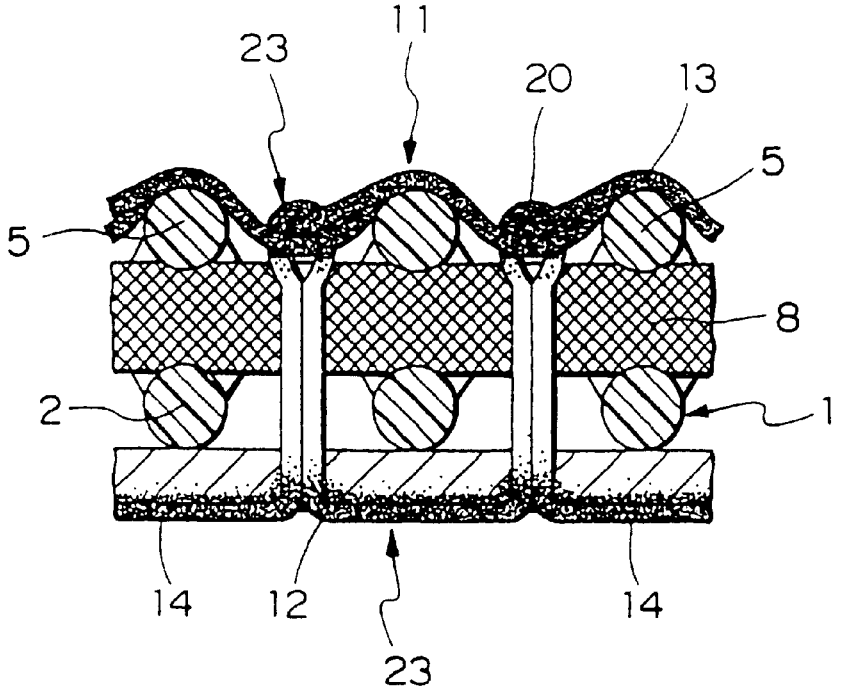
FIG. 7 is an enlarged fragmentary longitudinal sectional view of the linear slide fastener stringer according to a fourth embodiment of the present invention.

According to a linear slide fastener of a fourth embodiment of the invention shown In FIG. 7, In the fastener stringer, the coil-like fastener element 2 is used as the linear fastener element row 1 and the core thread 8 composed of synthetic fiber is made to run through an interior of this coil-like fastener element 2 and this coil-like fastener element 2 is sewed on the side edge of the fastener tape 10 with the looper yarn 13 and the needle yarn 14 as the sewing yarn 12 for double lock sewing system. Then, solution of the synthetic resin adhesive agent 24 is applied to an entire surface of the looper yarn 13 as the sewing yarn 12, the entangled portion 20 of the needle yarn 14 and a portion of the needle yarn 14 exposed on the rear side of the fastener tape 10, from the front and rear sides, so that It permeates them and hardens. Consequently, the looper yarn 13 and the needle yarn 14 are bonded with each other and on the rear side, the needle yarn 14 and the fastener tape 10 are bonded with each other. Because the synthetic resin material 23 is applied to the surface of the sewing yarn 12 as the attachment yarn 11, the strong attachment yarn 11 is formed. As a result, this linear slide fastener allows the slider to slide smoothly and has an excellent abrasion resistance against such a sliding.

Figure 8:
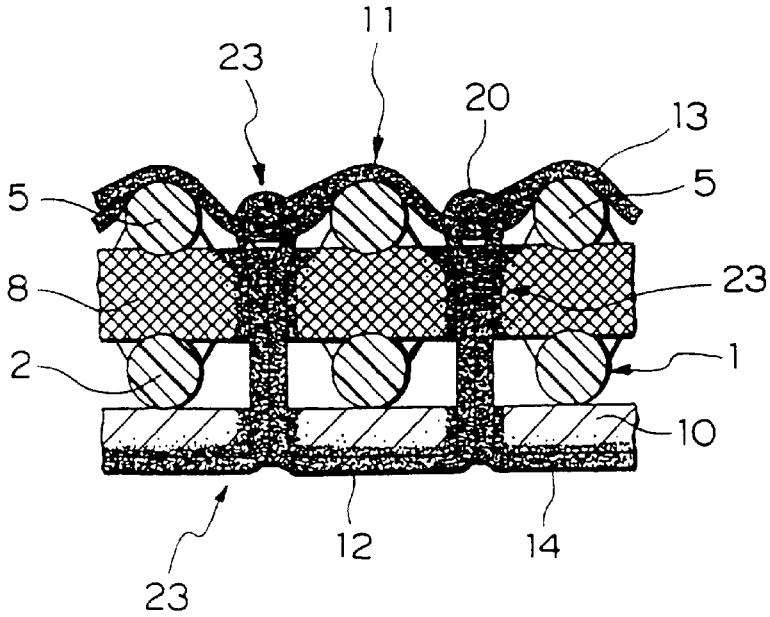
FIG. 8 is an enlarged fragmentary longitudinal sectional view of the linear slide fastener stringer according to a fifth embodiment of the present invention.

According to a linear slide fastener of a fifth embodiment of the invention shown in FIG. 8, in the fastener stringer the coil-like fastener element 2 is used as the linear fastener element row 1 and then, the core thread 8 composed of synthetic fiber is made to run through an interior of this coil-like fastener element 2 and this coil-like fastener element 2 is sewed on the side edge of the fastener tape lo with the looper yarn 13 and needle yarn 14 as the sewing yarn 12 for double lock sewing system. Then, solution of the synthetic resin adhesive agent 24 is applied to an entire surface of the looper yarn 13 as the sewing yarn 12, the entire needle yarn 14, a portion of the core thread 8 which the needle yarn 14 pierces, a portion of the fastener tape 10 which the needle yarn 14 pierces, and a portion of the fastener tape 10 where the needle yarn 14 which contacts the fastener tape 10, so that it permeates them and hardens. Consequently, the looper yarn 13 and needle yarn 14 as the sewing yarns, core thread 8 and the fastener tape 10 are bonded with each other integratedly, and because the synthetic resin material 23 is applied to the surface of the sewing yarn 12 as the attachment yarn 11, the strong attachment yarn 11 is formed. As a result, this linear slide fastener allows the slider to slide smoothly and has an excellent abrasion resistance against such a sliding.

Because according to this embodiment also, the needle yarn 14 and the core thread 8 are bonded with each other and are hardened, like the second and third embodiments, even when the looper yarn 13 is out due to abrasion, the coil-like fastener element 2 is never removed from the fastener tape 10. Further, even when an exposed portion of the needle yarn 14 exposed from the rear side of the fastener tape 10 is out due to abrasion, the coil-like fastener element 2 is never removed from the fastener tape 10 because the fastener tape 10 and the portion of the needle yarn 14 piercing the fastener tape 10 are bonded with each other so that they are hardened.

Figure 9:
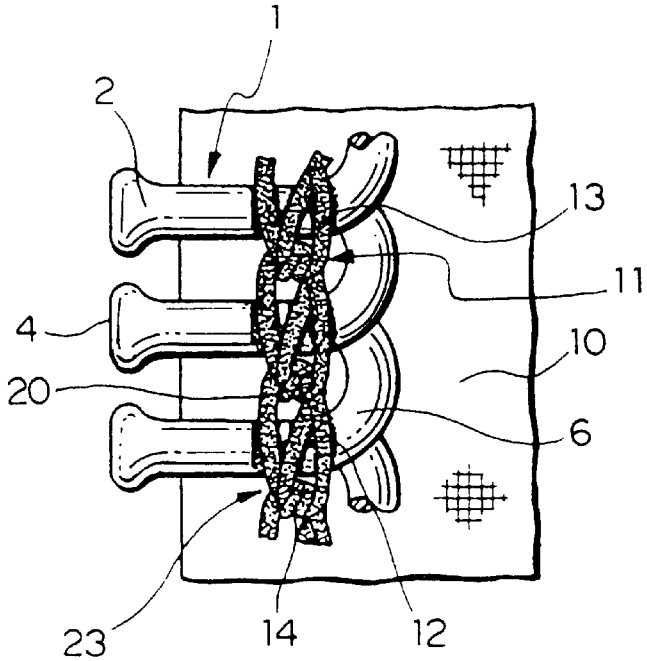
FIG. 9 is an enlarged fragmentary front view of the linear slide fastener stringer according to a sixth embodiment of the present invention.
Figure 10:
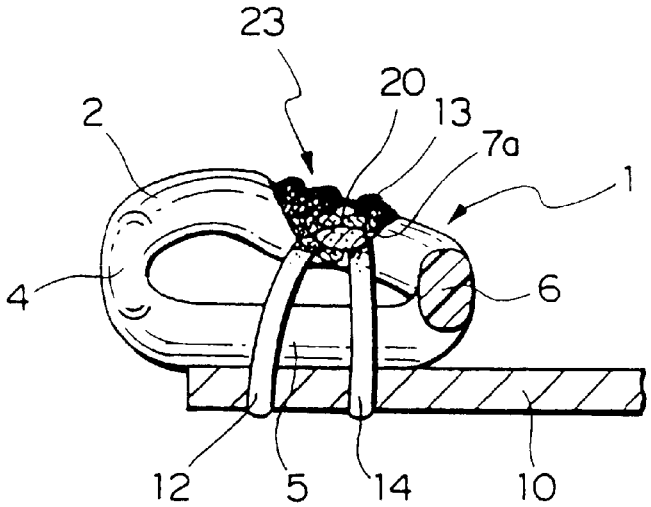
FIG. 10 is an enlarged fragmentary cross sectional view of the linear slide fastener stringer of FIG. 9.

According to a linear slide fastener of a sixth embodiment of the invention shown in FIGS. 9 and 10, the coil-like fastener element 2 is used as the linear fastener element row 1 and then, a step portion 7*a* for accommodating the sewing yarn 12 is formed in the upper leg portion 5 of this coil-like fastener element 2. The coil-like fastener element 2 is sawed to the side edge of the fastener tape 10 with the looper yarn 13 and needle yarn 14 as the sewing yarn 12 of the double lock sewing system so as to form the fastener stringer. Then, solution of the synthetic rein adhesive agent 24 is applied to an entire surface of the looper yarn 13 as the sewing yarn 12 disposed In the step portion 7*a* of the leg portion 5 and the entangled portion 20 of the needle yarn 14, so that it permeates them and hardens. Consequently, the looper yarn 13 and the needle yarn 14 are bonded with each other integratedly. Because the synthetic resin material 23 is applied to the surface of the sewing yarn 12 as the attachment yarn 11, the strong attachment yarn is formed. As a result, this linear slide fastener allows the slider to slide smoothly and has an excellent abrasion resistance against such a sliding.

Figure 11:
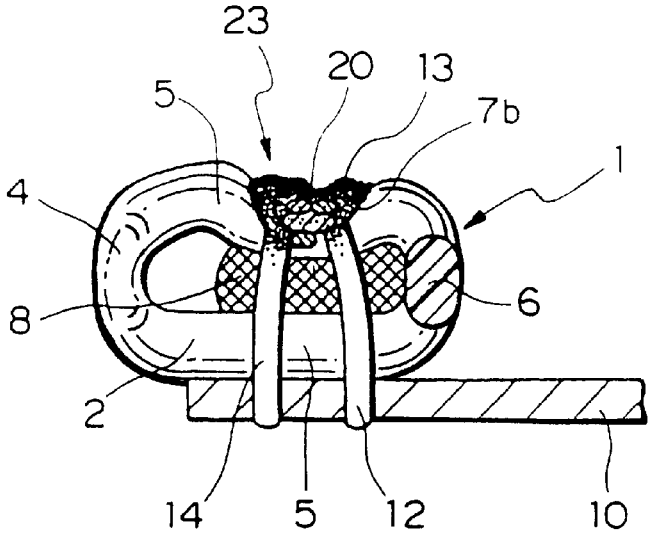
FIG. 11 is an enlarged fragmentary cross sectional view of the linear slide fastener stringer according to a seventh embodiment of the present invention.

According to a linear slide fastener of a seventh embodiment of the invention shown in FIG. 11, in the fastener stringer, the coil-like fastener element 2 is used as the linear fastener element row 1, and a concave portion 7*b* for accommodating the sewing yarn 12 is formed in the center of the upper leg portion 5 of this coil-like fastener element 2. The core thread 8 is made to ran through an interior of the coil-like fastener element 2 and this coil-like fastener element 2 is sewed to the side edge of the fastener tape 10 with the looper yarn 13 and needle yarn 14 as the sewing yarn 12 of the double lock sewing system so as to form a fastener stringer. Then, solution of the synthetic resin adhesive agent 24 is applied to an entire surface of the looper yarn 13 as the sewing yarn 12 disposed in the concave portion 7*b* formed in the upper leg portion 5 of the coil-like fastener element 2 and the entangled portion 20 of the needle yarn 14, so that it permeates them and hardens. Consequently the looper yarn 13 and needle yarn 14 are bonded with each other and fixed integratedly. Because the synthetic resin material 23 is applied to the surface of the sewing yarn 12 as the attachment yarn 11, the strong attachment yarn is formed. As a result, the produced linear slide fastener allows the slider to slide smoothly and has an excellent abrasion resistance against such a sliding.

Figure 12:
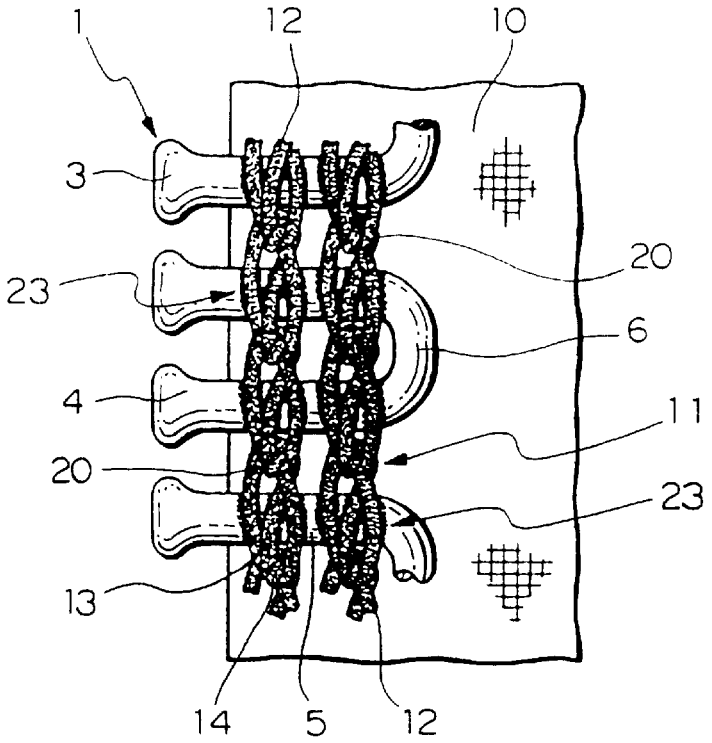
FIG. 12 is an enlarged fragmentary front view of the linear slide fastener stringer according to an eighth embodiment of the present Invention.
Figure 13:
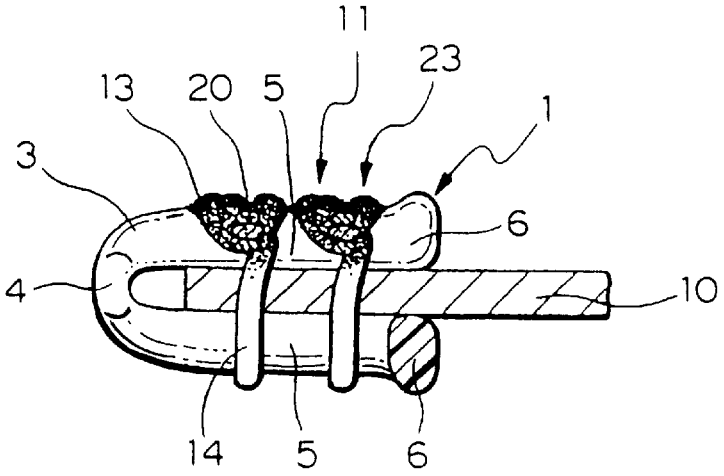
FIG. 13 is an enlarged fragmentary cross sectional view of the linear slide fastener stringer of FIG. 12.

According to a linear slide fastener of an eighth embodiment of the invention shown in FIGS. 12 and 13, the zigzag-like fastener element 3 is used as the linear fastener element row 1. This zigzag-like fastener element 3 is attached to the fastener tape 10 by nipping the side edge of the fastener tape 10 with the upper and lower leg portions 5 and the leg portions 5 of the zigzag-like fastener element 3 are sewed to the side edge by two rows of double lock sewing system each using two yarns by one needle. Then, solution of the synthetic resin adhesive agent 24 is applied to an entire surface of the looper yarn 13 as the sewing yarn 12 of the double lock sawing system exposed on the leg portion 5 of the zigzag-like fastener element 3 and the entangled portion 20 of the needle yarn 14 so that it permeates them and hardens. Because the synthetic resin 23 is applied to the surface of the sewing yarn 12 as the attachment yarn 11, the strong attachment yarn 11 is formed.

As a result, the produced linear slide fastener allows the slider to slide smoothly and has an excellent abrasion resistance against such a sliding.

Figure 14:
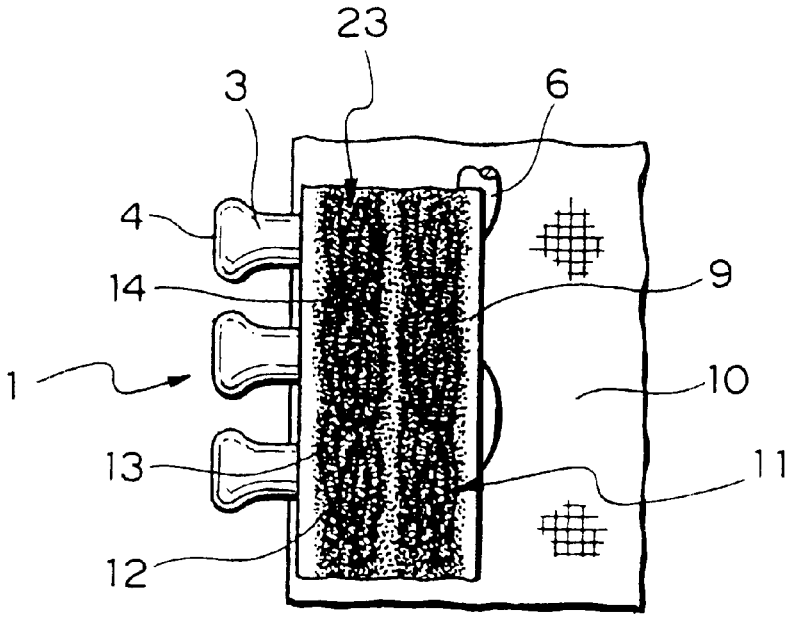
FIG. 14 is am enlarged fragmentary front view of the linear slide fastener stringer according to a ninth embodiment of the present invention.
Figure 15:
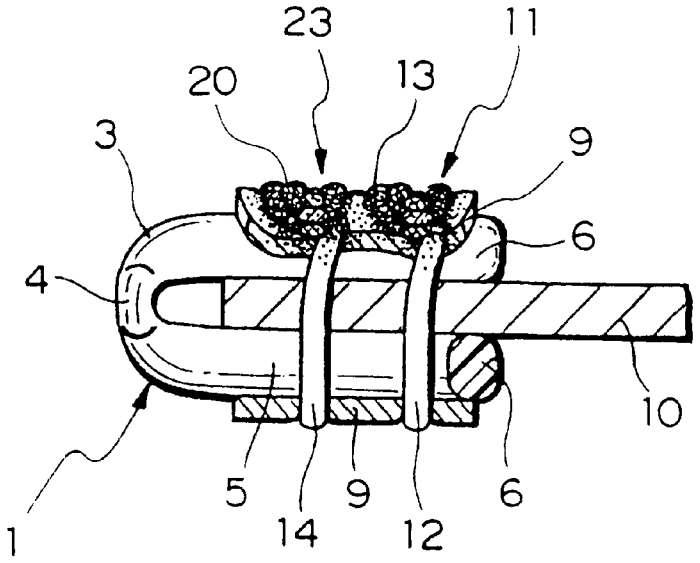
FIG. 15 is an enlarged fragmentary cross sectional view of the linear slide fastener stringer of FIGS. 14.

According to a linear slide fastener of a ninth embodiment of the invention shown in FIGS. 14 and 15, the zigzag-like fastener element 3 is used as the linear fastener element row 1. This zigzag-like fastener element 3 is attached to the fastener tape 10 by nipping the side edge of the fastener tape 10 with the upper and lower leg portions 5. The blade 9 is placed on the upper leg portion 5 of the zigzag-like fastener element 3 and this blade 9 is sewed by two rows of double lock sewing system each using two yarns by one needle. Solution of the synthetic resin adhesive agent 24 is applied to an entire surface of the looper yarn 13 as the sewing yarn 12 of the double lock sewing system exposed on the blade 9 placed on the zigzag-like fastener element 3, the entangled portion 20 of the needle yarn 14 and a portion of the blade 9 along the looper yarn 13, so that it permeates them and hardens. Consequently, the looper yarn 13, the needle yarn 14 and the blade 9 are bonded with each other integratedly. Because the synthetic resin 23 is applied to the surface of the sewing yarn 12 as the attachment yarn 11, the strong attachment yarn 11 is formed. As a result, the produced linear slide fastener allows the slider to slide smoothly and has an excellent abrasion resistance against such a sliding.

Figure 16:
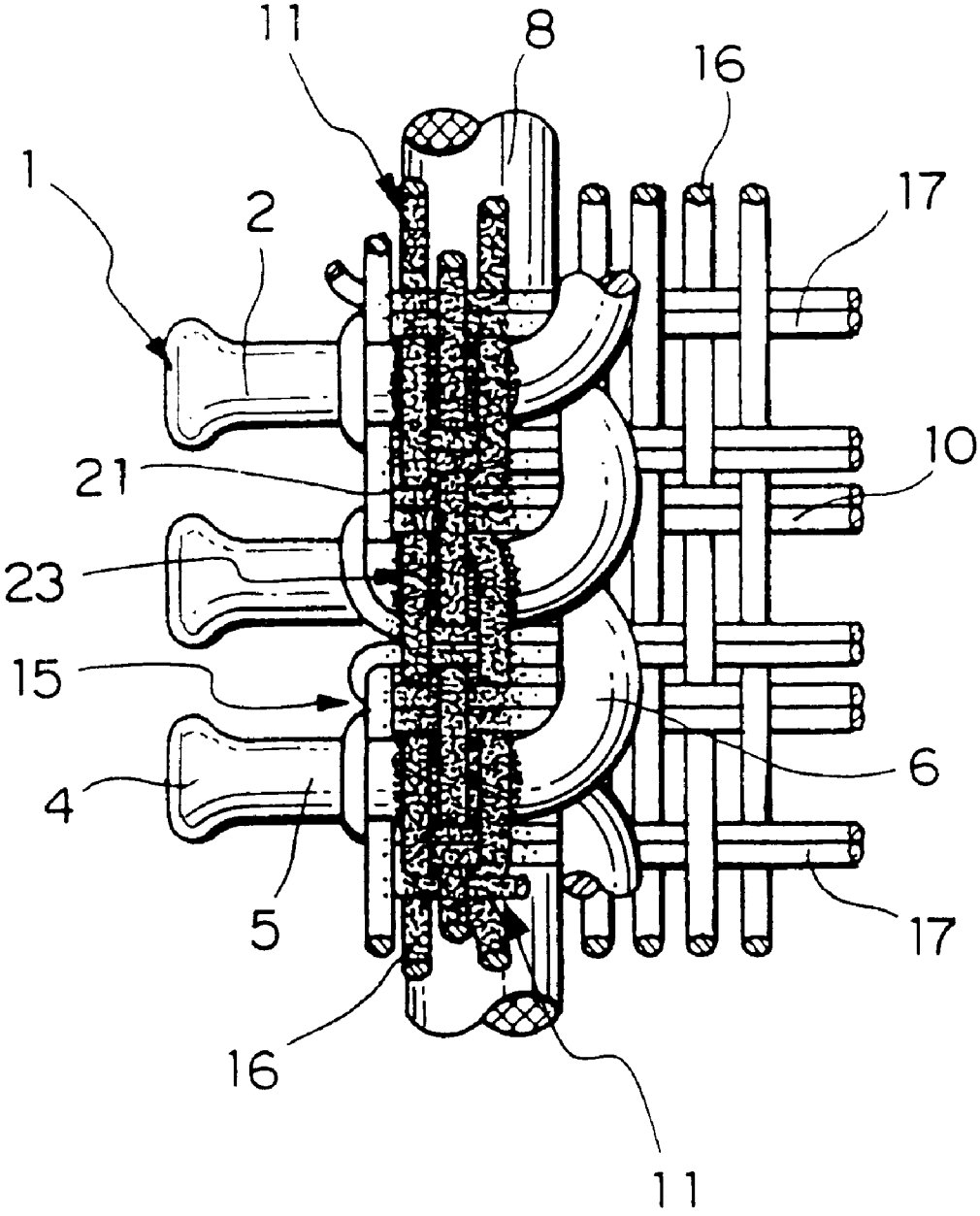
FIG. 16 is an enlarged fragmentary front view of the linear slide fastener stringer according to a tenth embodiment of the present invention.

According to a linear slide fastener of a tenth embodiment of the invention shown in FIG. 16, in the fastener stringer, the coil-like fastener element 2 is used as the linear fastener element row 1. With the core thread 8 inserted through this coil-like fastener element 2, the fastener tape 10 is woven and the coil-like fastener element 2 is woven into the side edge of the fastener tape 10 with weaving yarns 15 so as to form a fastener stringer. Then, solution of the synthetic resin adhesive agent 24 is applied to an entire surface of warp 16 as the attachment yarn 11 for attaching the coil-like fastener element 2 disposed so as to expose on the upper leg portion 5 of the coil-like fastener element 2, an intersecting portion 21 of weft 17 of double pick intersecting with this warp 16 and the surface of the core thread 8, so that it permeates them and hardens. Consequently, the warp 16 and weft 17 exposed on the coil-like fastener element 2 and the core thread 8 are bonded with each other integratedly. Because the synthetic resin material 23 is applied to the surface of the warp 16 and weft 17 of the weaving yarn 15 as the attachment yarn 11, the strong attachment yarn 11 is formed. As a result, the manufactured linear slide fastener allows the slider to slide smoothly and has an excellent abrasion resistance against such a sliding.

Figure 17:
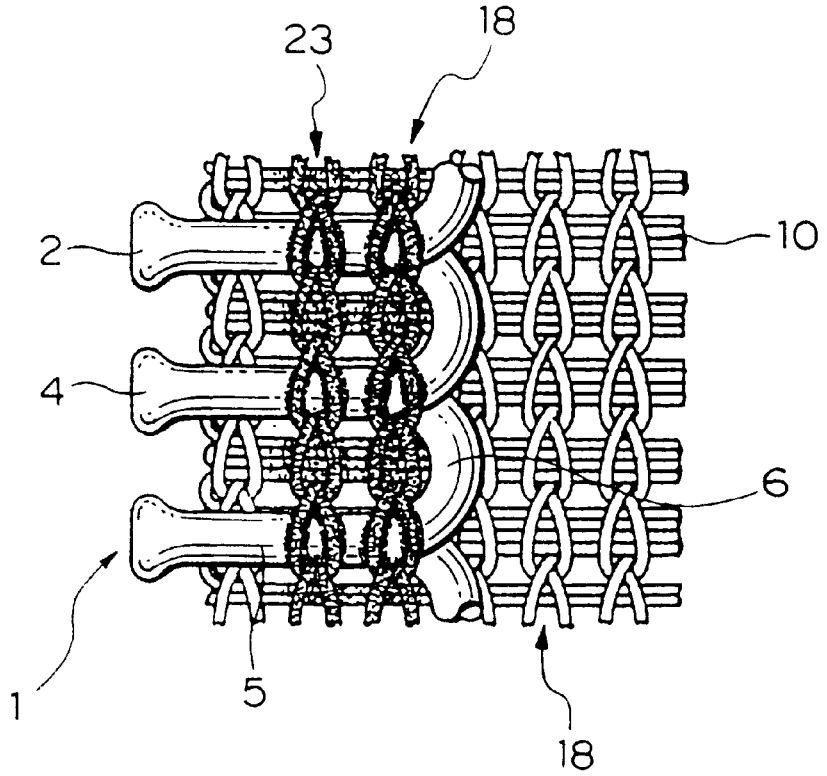
FIG. 17 is an enlarged fragmentary front view of the linear slide fastener stringer according to an eleventh embodiment of the present invention.

According to a linear slide fastener of an eleventh embodiment of the invention shown in FIG. 17, in the fastener stringer, the coil-like fastener element 2 is used as the linear fastener element row 1. This coil-like fastener element 2 is woven into the side edge of the fastener tape 10 at the same time when the fastener tape 10 is woven with warp knitting yarn 18 so as to form a fastener stringer. Solution of the synthetic resin adhesive agent 24 is applied to the entangled portion 20 or intersecting portion 21 exposed on the coil-like fastener element 2 of the warp knitting yarn 18 for weaving the coil-like fastener element 2 into the fastener tape 10 such as chain stitch yarn, tricot knitting yarn and weft insertion yarn so that it permeates it and hardens. Consequently, the warp knitting yarns 18 are bonded with each other integratedly. Because the synthetic resin material 23 is applied on the surface of the warp knitting yarn 18 as the attachment yarn 11, the strong attachment yarn 11 is formed. As a result, the manufactured linear slide fastener allows the slider to slide smoothly and has an excellent abrasion resistance against such a sliding.

Although solution of the synthetic resin adhesive agent 24 is used to apply the synthetic resin material 23 so that it permeates the attachment yarn 11, for attaching the linear fastener element row 1 of the linear slide fastener onto the fastener tape 10 and hardens therein, a synthetic resin film 25, synthetic resin mono-filament 26 or synthetic resin powder 27 may be used as the synthetic resin material 23, as well as the synthetic resin adhesive agent 24.

By melting the synthetic resin material 23 by heating, the melted resin material is applied to the attachment yarn 11 so that it permeates it and hardens. As the synthetic resin material 23, thermoplastic resin is used. In this case, it in preferable to use the synthetic resin film 25, synthetic resin mono-filament as or synthetic resin powder 27 having a melting point lower than those of materials for the linear fastener element row 1, core thread 8, blade 9, fastener tape 10 and attachment yarn 11 of the fastener stringer.

Figure 18:
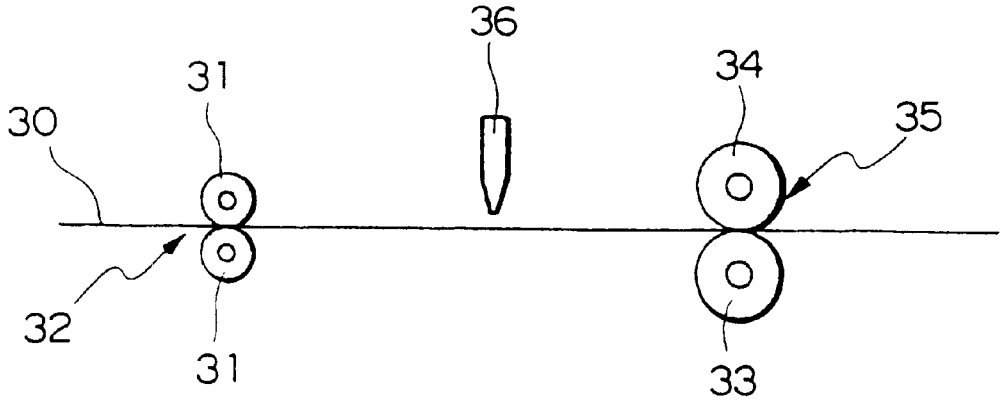
FIG. 18 is a schematic diagram showing a first example of a manufacturing process of a linear slide fastener.
Figure 19:
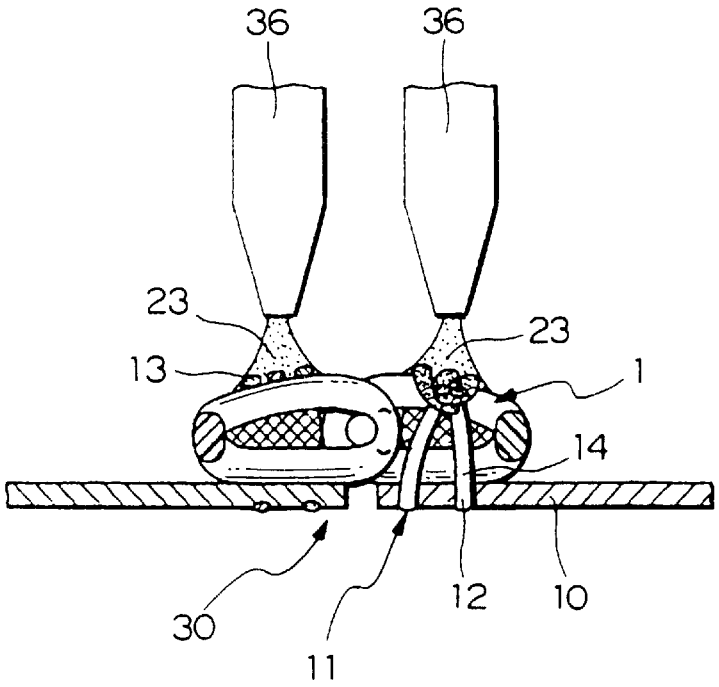
FIG. 19 is a schematic diagram showing a step for applying resin adhesive agent in the manufacturing process of FIG. 18.
Figure 20:
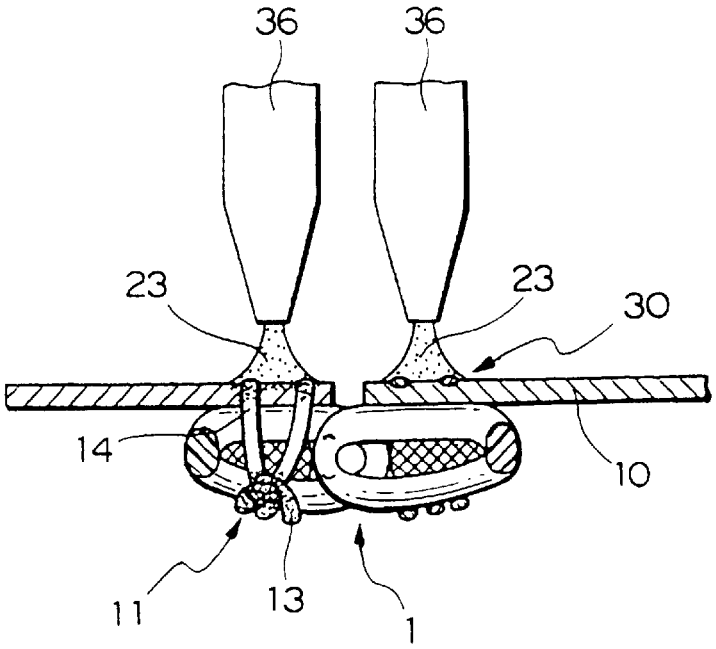
FIG. 20 is a schematic diagram showing a step for applying resin adhesive agent to a rear aide of a fastener tape in the aforementioned manufacturing process .

Next, a manufacturing method of the linear slide fastener will be described. The linear fastener element row 1 formed of mono-filament such as pdlyamide or polyethylene in the shape of coil or zigzag is attached to the side edge of the fastener tape 10, knitted or woven with synthetic fiber of polyamide, polyethylene or the like, using multi-fiber attachment yarn 11 formed of synthetic fiber multi-filament by sewing means, weaving means or knitting means so as to form a fastener chain 30. Then, as schematically shown in FIG. 18, this fastener chain 30 is fed into a guide portion 32 in which guide rollers 31 are disposed up and down and then, carried to a carrying portion 35 in which a driving roller 33 and a pressing roller 34 are disposed up and down. Then, a nozzle 36 is disposed in the middle between the guide portion 32 and carrying portion 35 so as to oppose the stretched fastener chain 30. Solution of the synthetic resin adhesive agent 24, which is used as the synthetic resin material 23 and which hardens at the ambient temperature, is applied from this nozzle 36 to the attachment yarn 11 of the fastener chain 30 as shown in FIG. 19, so that it permeates the attachment yarn 11. Then, the fastener chain 30 in transported to the carrying portion 35 and discharged. Further, as shown in FIG. 20, the fastener chain 30 is turned upside down and solution of the synthetic resin adhesive agent 24 is applied to the attachment yarn 11 disposed on the rear of the fastener chain 30, so that it permeates the attachment yarn 11 and hardens.

Figure 21:
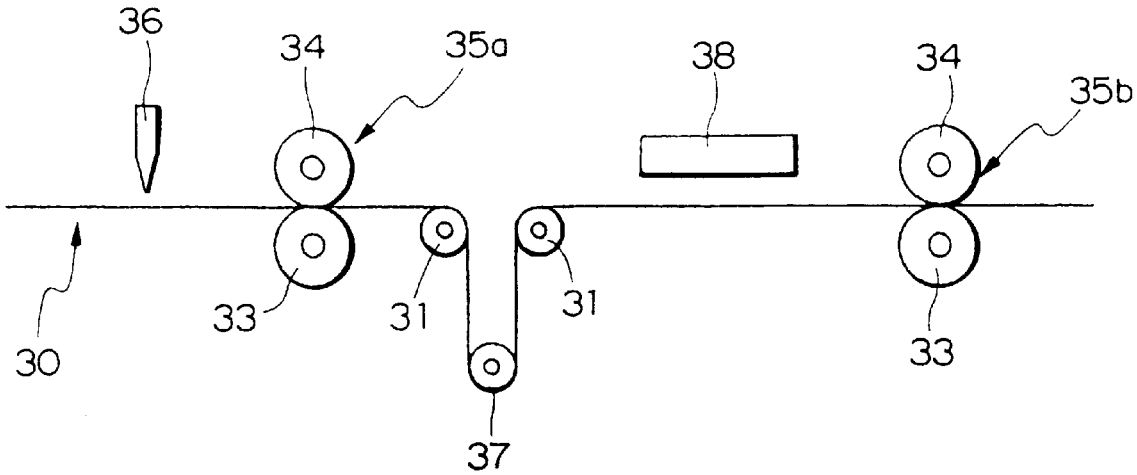
FIG. 21 is a schematic diagram showing a second embodiment of a manufacturing process of a linear slide fastener.

When the synthetic resin adhesive agent 24, which is applied to the attachment yarn 11 so that it permeates, is thermosetting, as shown in FIG. 21, a heater 38 is disposed so as to heat the fastener chain 30 stretched in a post process of a first carrying portion 35*a* from above and a second carrying portion 35*b* composed of the driving roller 33 and pressing roller 34 is disposed subsequent thereto. After solution of the synthetic resin adhesive agent 24 is applied to permeate, the fastener chain 30 is heated by the heater 38 so that the adhesive agent 24 is hardened and the attachment yarn 11 is coated with the synthetic resin material 23. Meanwhile, reference numeral 37 denotes a dancer roller, which is capable of moving up or down so as to adjust the amount of feeding of the fastener chain 30 between the first and second carrying portions 35*a* and 35*b*.

Figure 22:
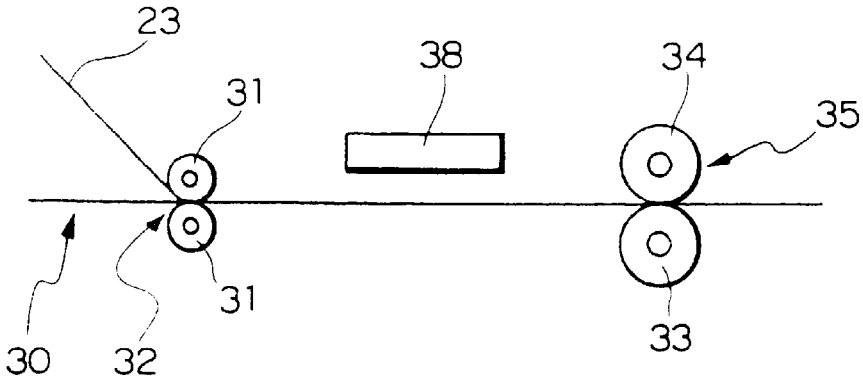
FIG. 22 is a schematic diagram showing a third embodiment of a manufacturing process of a linear slide fastener.
Figure 23:
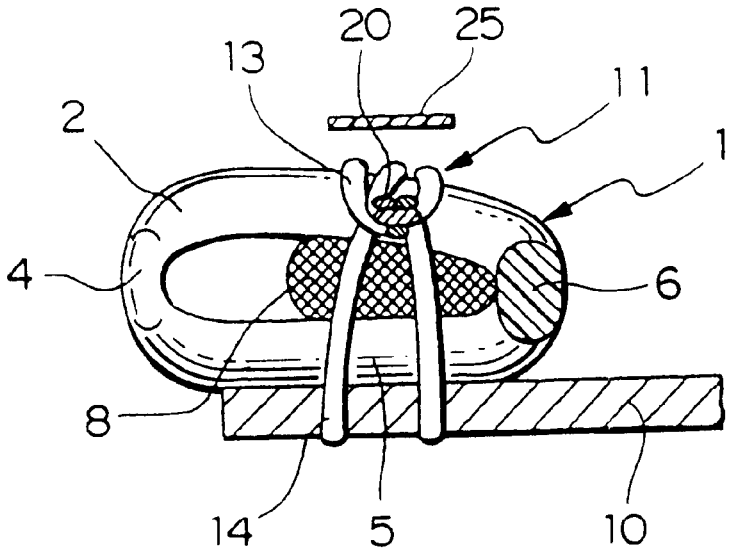
FIG. 23 is an explanatory diagram showing a condition in which synthetic resin film is attached.
Figure 24:
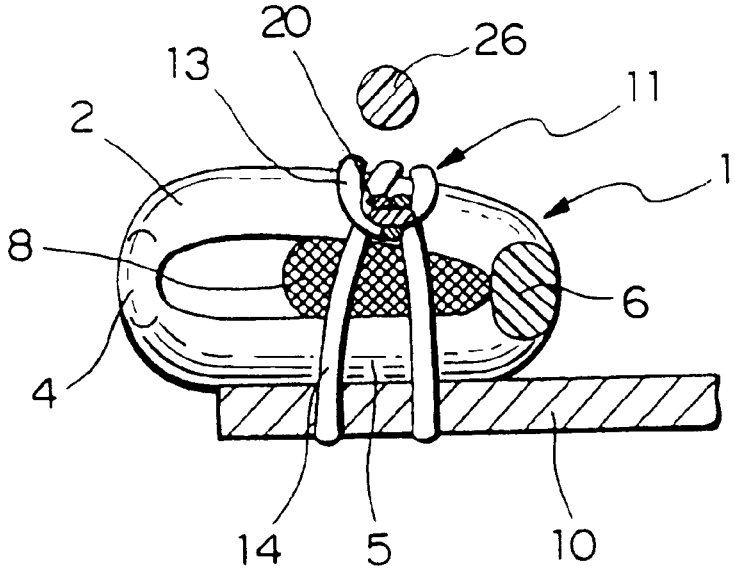
FIG. 24 is an explanatory diagram showing a condition in which synthetic resin mono-filament is attached.

When the attachment yarn 11 is coated with the synthetic resin material 23 by using the synthetic resin film 25 or synthetic resin mono-filament 26, as shown In FIG. 22, the fastener chain 30 and the synthetic resin material 23 of the synthetic resin film 25 or synthetic resin mono-filament 26 are supplied in between the upper and lower guide rollers 31 such that the synthetic resin material 23 opposes the attachment yarn 11 which attaches the linear fastener element row 1 of the fastener chain 30. Then, the heater 38 is disposed above the fastener chain 30 stretched between the guide portion 32 and the carrying portion 35 composed of the driving roller 33 and pressing roller 34. The synthetic resin film 25 or synthetic resin mono-filament 26, attached to the attachment yarn 11 as shown in FIGS. 23 and 24, is heated and melted by this heater 36, so that solution of the synthetic resin material 23 is applied to the attachment yarn 11 so that it permeates and harden. As a result, the attachment yarn 11 is coated with the synthetic resin 23.

Figure 25:
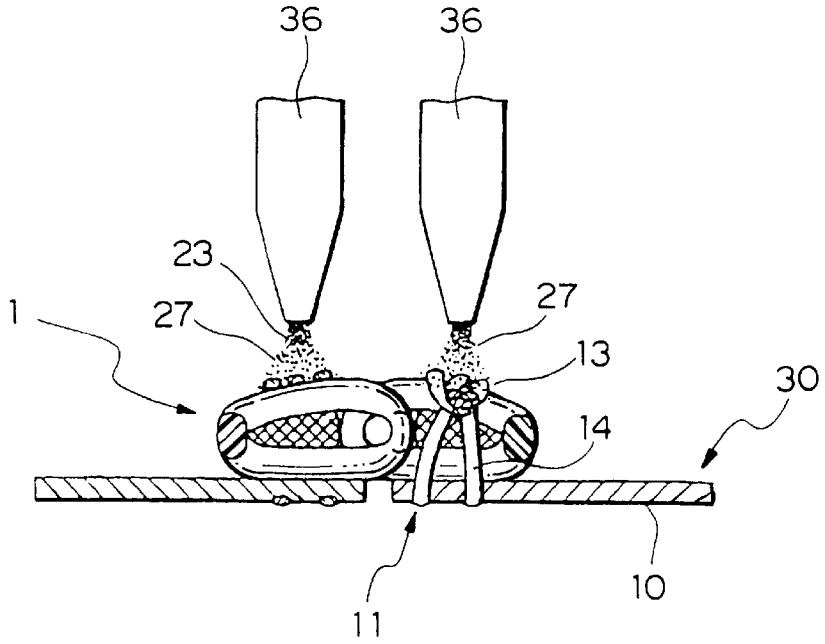
FIG. 25 is an explanatory diagram showing a condition in which synthetic resin powder is applied.
Figure 26:
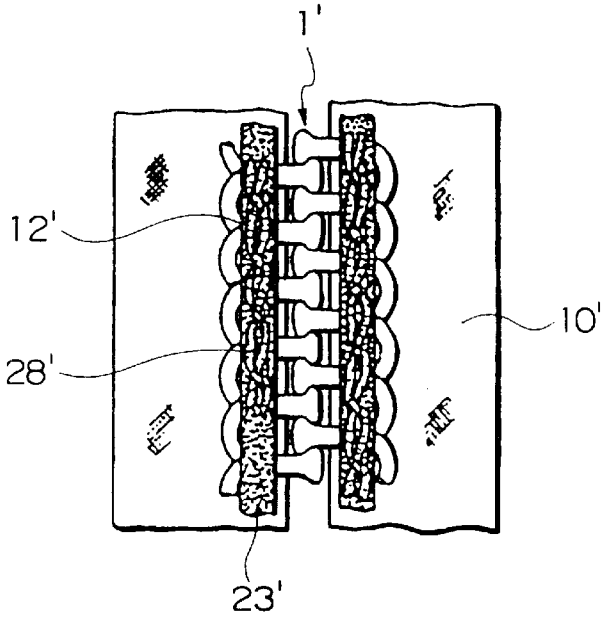
FIG. 26 PRIOR ART
FIG. 26 is a front view showing a well known linear slide fastener chain.

When it is intended to use the synthetic resin powder 27 as the synthetic resin material 23 and fix the synthetic resin material 23 to the attachment yarn 11, the nozzle 36 and heater 38 are disposed between the guide portion 32 and carrying portion 35, and then, as shown in FIG. 25, the synthetic resin powder 27 is sprayed to the attachment yarn 11 from the nozzle 36 so that it is applied thereto. After that, thus applied synthetic resin powder 27 is heated and melted by the heater 38 so that it permeates the attachment yarn 11 and hardens. Consequently, the attachment yarn 11 is coated with the synthetic resin material 23.

The linear slide fastener and production method of the present invention have the above described structure, which realize the following effects.

According to the invention, there is provided a slide fastener, wherein the linear fastener element row 1 is attached to the side edge of the fastener tape 10 with the attachment yarn 11; and synthetic resin material 23 having adhesive property is applied to the attachment yarn 11 fixed In tightened state so that the synthetic resin material 23 permeates the attachment yarn 11 and hardens to coat and fix the attachment yarn 11. As a result, the attachment yarn 11 can be formed to be strong, highly abrasion resistant yarn and by bonding the yarns with each other, the linear fastener element can be fixed in a stabilized condition. Thus, an excellent guide performance can be exerted for the slider so that the slider can be slid smoothly.

According to the invention, the linear fastener element row 1 is sewed to the side edge of the fastener tape 10 using the sewing yarn 12 as the attachment yarn 11 or woven into the side edge of the fastener tape 10 using the weaving yarn 15 or knitted into the side edge of the fastener tape 10 using the warp knitting yarn 18. As a result in various types of the linear slide fastener, the linear fastener element can be fixed to the fastener tape 10 such that the attachment yarn 11 is organized in a stabilized condition. Thus, a deviation or the linear fastener element in prevented and the yarn is prevented from being cut out, so that an excellent quality linear slide fastener is provided.

According to the invention, the synthetic resin material 23 is applied to the entangled portion 20 or intersecting portion 21 of each attachment yarn 11 so that It permeates, and the respective attachment yarns 11 are bonded with each other integratedly by the synthetic resin material 23 so that the attachment yarns 11 are coated and fixed with the synthetic resin material 23. Thus, the linear fastener element can be fixed firmly with the attachment yarns 11.

According to the invention, the synthetic resin material 23 is applied to the attachment yarn 11 and the core thread 8 or the blade 9 to permeate so that the attachment yarn 11 and core thread 8 or blade 9 is hardened integratedly with the synthetic resin. As a result, the linear fastener element can be fixed firmly in cooperation of the attachment yarn 11, and the core thread 8 or blade 9.

According to the invention, the synthetic resin material 23 is applied to the attachment yarn 11 and fastener tape 10 to permeate them so that the attachment yarn 11 and fastener tape 10 are hardened integratedly with the synthetic resin. As a result, the linear fastener element can be fixed firmly in cooperation of the attachment yarn 11 and fastener tape 10.

According to the invention, the synthetic resin material 23 is applied to the attachment yarn 11 exposed on the rear side of the fastener tape 10 to permeate the attachment yarn 11 and harden. As a result, the attachment yarn on the rear of the fastener tape 10 is reinforced thereby preventing the yarn from being out.

According to the invention, synthetic resin material 23 suitable for various types of the linear slide fastener is selected using solution of the synthetic resin adhesive agent 24, synthetic resin film 25, synthetic resin mono-filament 26, or synthetic resin powder 27. As a result,the linear fastener element can be attached to the fastener tape 10 firmly in a stabilized condition.

According to the invention, the synthetic resin material 23 has a melting point lower than that of material of the fastener stringer. As a result, when the synthetic resin material 23 is applied to the fastener stringer to permeate and harden, this operation can be carried out easily without damaging the fastener stringer.

According to the invention, there is provided a manufacturing method of the linear slide fastener for fixing the linear fastener element row 1 to the fastener tape 10, comprising the steps of: attaching the linear fastener element row 1 to the side edge of the fastener tape 10 with multi-fiber attachment yarn 11; applying synthetic resin material 23 to the attachment yarn 11 disposed on the top surface of the linear fastener element row 1 so that the synthetic resin permeates; and applying the synthetic resin material 23 to permeate the attachment yarn 11 to harden, so that the attachment yarn 11 is coated and fixed with the synthetic resin material 23. Consequently, with such a simple production process, the linear fastener element can be fixed stably and an excellent quality, strong linear slide fastener having no possibility of yarn cut-out can be produced easily.

According to the invention, the manufacturing method further comprises a step of applying the synthetic resin material 23 to the attachment yarn 11 exposed on the rear side of the fastener tape 10 so that the synthetic resin material permeates and hardens. Consequently, the synthetic resin material 23 can be applied to the attachment yarn 11 exposed on the rear of the fastener tape 10 to permeate and harden. Thus, a stabilized excellent quality linear slide fastener can be produced.

According to the invention, solution of the synthetic resin adhesive agent 24 is used as the synthetic resin material 23 and the manufacturing method further comprises a step of applying the adhesive agent 24 to the attachment yarn 11 to permeate and harden. Consequently, the resin adhesive agent 24 can be used easily and the synthetic resin material 23 can be applied to the attachment yarn 11 effectively, thereby improving the working efficiency.

According to the invention, the manufacturing method further comprises a step of attaching or applying the synthetic resin film 25, synthetic resin mono-filament 26, or synthetic resin powder 27 to the attachment yarn 11 and melting by heating. Therefore, all types of the synthetic resin can be used. An appropriate synthetic resin material 23 can be selected easily depending on the type of the slide fastener and such a linear slide fastener can be produced easily. As described above the present invention exerts remarkable effects.

What is claimed is:

1. A linear slide fastener, wherein a linear fastener element row is attached to a side edge of a fastener tape with a multi-fiber attachment yarn; and synthetic resin material having adhesive property is applied to the attachment yarn so that the synthetic resin material permeates the attachment yarn and hardens to coat and fix the attachment yarn;

wherein the synthetic resin material is applied to an entangled portion or intersecting portion of the attachment yarn so as to permeate and the respective attachment yarns are bonded with each other integratedly by the synthetic resin material so that the attachment yarns are coated and fixed with the synthetic resin material.

2. A linear slide fastener, wherein a linear fastener element row is attached to a side edge of a fastener tape with a multi-fiber attachment yarn; and synthetic resin material having adhesive property is applied to the attachment yarn so that the synthetic resin material permeates the attachment yarn and hardens to coat and fix the attachment yarn;

wherein said synthetic resin material is applied to the attachment yarn and a core thread incorporated by the linear fastener element row or a blade attached to the linear fastener element row to permeate so that said attachment yarn and core thread or blade is hardened integratedly with said synthetic resin material so as to coat and fix the attachment yarn with the synthetic resin material.

3. A linear slide fastener, wherein a linear fastener element row is attached to a side edge of a fastener tape with a multi-fiber attachment yarn; and synthetic resin material having adhesive property is applied to the attachment yarn so that the synthetic resin material permeates the attachment yarn and hardens to coat and fix the attachment yarn;

wherein said synthetic resin material is applied to the attachment yarn and fastener tape to permeate them so that said attachment yarn and fastener tape are hardened integratedly with said synthetic resin material so as to coat and fix the attachment yarn with the synthetic resin material.

4. A linear slide fastener, wherein a linear fastener element row is attached to a side edge of a fastener tape with a multi-fiber attachment yarn; and synthetic resin material having adhesive property is applied to the attachment yarn so that the synthetic resin material permeates the attachment yarn and hardens to coat and fix the attachment yarn;

wherein said synthetic resin material is applied to the attachment yarn exposed on the rear side of the fastener tape to permeate the attachment yarn and harden so that said attachment yarn on the rear side is coated and fixed with the synthetic resin material.

5. A linear slide fastener according to claim 1, 2, 3, or 4, wherein said synthetic resin material is formed of solution of synthetic resin adhesive agent.

6. A linear slide fastener according to claim 1, 2, 3, or 4, wherein said synthetic resin material is formed of synthetic resin film.

7. A linear slide fastener according to claim 1, 2, 3, or 4, wherein said synthetic resin material is formed of synthetic resin mono-filament.

8. A linear slide fastener according to claim 1, 2, 3, or 4, wherein said synthetic resin material is formed of synthetic resin powder.

9. A linear slide fastener according to claim 1, 2, 3, or 4, wherein said synthetic resin material is formed of synthetic resin material having a lower melting point than that of material of the fastener stringer.

10. A linear slide fastener according to claims 1, 2, 3, or 4, wherein the linear fastener element row is sewed to the side edge of the fastener tape using a sewing yarn as the attachment yarn.

11. A linear slide fastener according to claim 1, 2, 3, or 4, wherein the linear fastener element row is woven into the side edge of the fastener tape using a weaving yarn as the attachment yarn.

12. A linear slide fastener according to claim 1, 2, 3, or 4, wherein the linear fastener element row is knitted into the side edge of the fastener tape using a warp knitting yarn as the attachment yarn.

* * * * *

UNITED STATES PATENT AND TRADEMARK OFFICE

CERTIFICATE OF CORRECTION

PATENT NO. : 6,516,499 B2
DATED : February 11, 2003
INVENTOR(S) : Yamaguchi et al.

It is certified that error appears in the above-identified patent and that said Letters Patent is hereby corrected as shown below:

Title page,
Item [57], ABSTRACT,
Line 4, "out out" should read -- cut out --;
Line 13, "material," should read -- material. --; and Column 14,
Line 16, "claims" should read -- claim --.

Signed and Sealed this

Sixteenth Day of September, 2003

JAMES E. ROGAN
*Director of the United States Patent and Trademark Office*